US011253036B1

(12) United States Patent
Stobbs, II

(10) Patent No.: US 11,253,036 B1
(45) Date of Patent: Feb. 22, 2022

(54) SUITCASE

(71) Applicant: Litz Dance Company, Inc., Carlsbad, CA (US)

(72) Inventor: Charles K. Stobbs, II, Hillsboro, OR (US)

(73) Assignee: Litz Dance Company, Inc., Carlsbad, CA (US)

( * ) Notice: Subject to any disclaimer, the term of this patent is extended or adjusted under 35 U.S.C. 154(b) by 332 days.

(21) Appl. No.: 16/448,174

(22) Filed: Jun. 21, 2019

Related U.S. Application Data

(60) Provisional application No. 62/695,340, filed on Jul. 9, 2018.

(51) Int. Cl.

| | |
|---|---|
| ***A45C 13/03*** | (2006.01) |
| ***A45C 5/03*** | (2006.01) |
| ***A45C 13/26*** | (2006.01) |
| ***A45C 5/14*** | (2006.01) |

(52) U.S. Cl.
CPC ..... *A45C 13/03* (2013.01); *A45C 5/03* (2013.01); *A45C 5/14* (2013.01); *A45C 13/262* (2013.01); *A45C 2013/267* (2013.01)

(58) Field of Classification Search
CPC .. A45C 13/03; A45C 5/03; A45C 5/14; A45C 13/262; A45C 2013/267
See application file for complete search history.

(56) References Cited

U.S. PATENT DOCUMENTS

| | | | | |
|---|---|---|---|---|
| 971,647 | A * | 10/1910 | Vanderveld | E06B 9/323 248/251 |
| 1,340,565 | A * | 5/1920 | Seidenburg | A47B 61/06 211/1.3 |
| 4,736,854 | A | 4/1988 | King et al. | |
| 4,782,947 | A | 11/1988 | Sheiman | |
| 4,905,826 | A | 3/1990 | Martin | |
| 5,054,589 | A | 10/1991 | Bomes et al. | |
| 5,180,057 | A | 1/1993 | Astrum et al. | |
| 5,398,807 | A | 3/1995 | Plath | |
| 5,437,367 | A | 8/1995 | Martin | |
| 5,474,162 | A * | 12/1995 | Shyr | A45C 5/14 190/109 |
| 5,501,324 | A | 3/1996 | Franklin et al. | |
| 5,878,757 | A | 3/1999 | Hernandez | |
| 6,073,738 | A * | 6/2000 | Abraham | A45C 13/03 190/109 |
| 6,076,641 | A | 6/2000 | Kinzer et al. | |
| 6,102,172 | A | 8/2000 | Dercole | |
| D507,876 | S | 8/2005 | Fadely | |
| 8,011,484 | B2 * | 9/2011 | McIntyre | A45C 5/04 190/110 |
| 8,607,947 | B2 | 12/2013 | Morszeck | |
| 9,198,492 | B2 | 12/2015 | Chehebar | |
| 9,894,970 | B2 * | 2/2018 | Sheikh | A45C 13/00 |

(Continued)

FOREIGN PATENT DOCUMENTS

| | | | |
|---|---|---|---|
| CA | 2635328 | A1 | 12/2009 |
| CN | 202774631 | U | 3/2013 |

(Continued)

*Primary Examiner* — Tri M Mai
(74) *Attorney, Agent, or Firm* — Ulmer & Berne LLP

(57) ABSTRACT

A suitcase is provided that includes a front door, a main body, a plurality of wheels, and a garment hanger assembly that is slidable between an extended position and a retracted position.

1 Claim, 11 Drawing Sheets

(56) References Cited

U.S. PATENT DOCUMENTS

| | | | | |
|---|---|---|---|---|
| 10,028,561 | B2 | 7/2018 | Vecellio | |
| 10,028,562 | B2 * | 7/2018 | Matthew | A45C 3/004 |
| 10,034,527 | B2 | 7/2018 | Korey et al. | |
| 2004/0154889 | A1 | 8/2004 | Gifford et al. | |
| 2005/0224305 | A1 | 10/2005 | Davis | |
| 2006/0196743 | A1 | 9/2006 | Lin | |
| 2014/0299431 | A1 | 10/2014 | Lusson | |

FOREIGN PATENT DOCUMENTS

| | | | |
|---|---|---|---|
| CN | 202890846 | U | 4/2013 |
| CN | 203646669 | U | 6/2014 |
| CN | 206866839 | U | 1/2018 |
| EP | 2904926 | B1 | 7/2017 |
| TW | M408980 | U | 8/2011 |

* cited by examiner

SUITCASE

REFERENCE TO RELATED APPLICATIONS

This application claims priority of U.S. provisional patent application Ser. No. 62/695,340, entitled Suitcase, filed Jul. 9, 2018 and hereby incorporates this provisional patent application by reference herein in its entirety.

TECHNICAL FIELD

The articles and methods described below generally relate to a suitcase for retaining garments and other items.

BACKGROUND

Conventional suitcases are typically difficult to pack and unpack when standing upright.

BRIEF DESCRIPTION OF THE DRAWINGS

Various embodiments will become better understood with regard to the following description, appended claims and accompanying drawings wherein:

DETAILED DESCRIPTION

Figure 1:
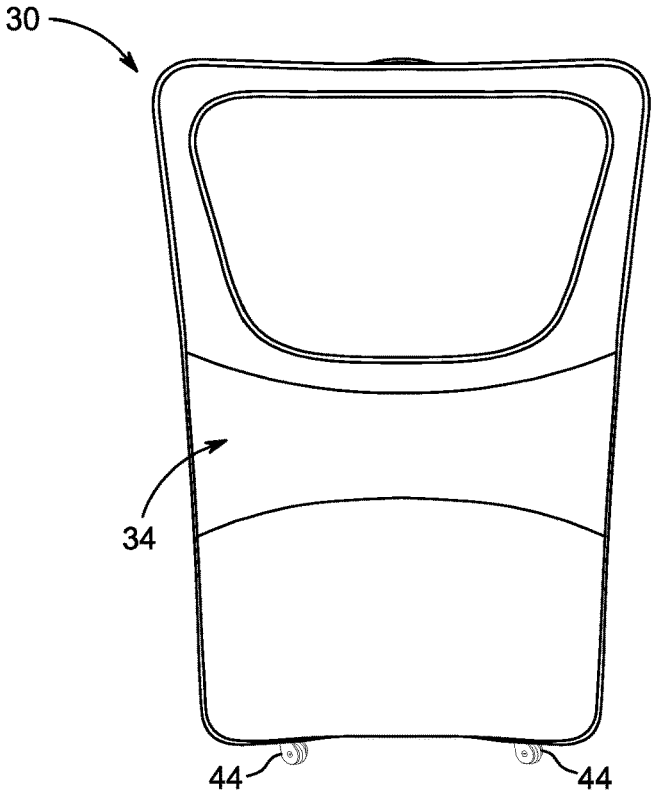
FIG. 1 is a front elevational view depicting a suitcase according to one embodiment.
Figure 2:
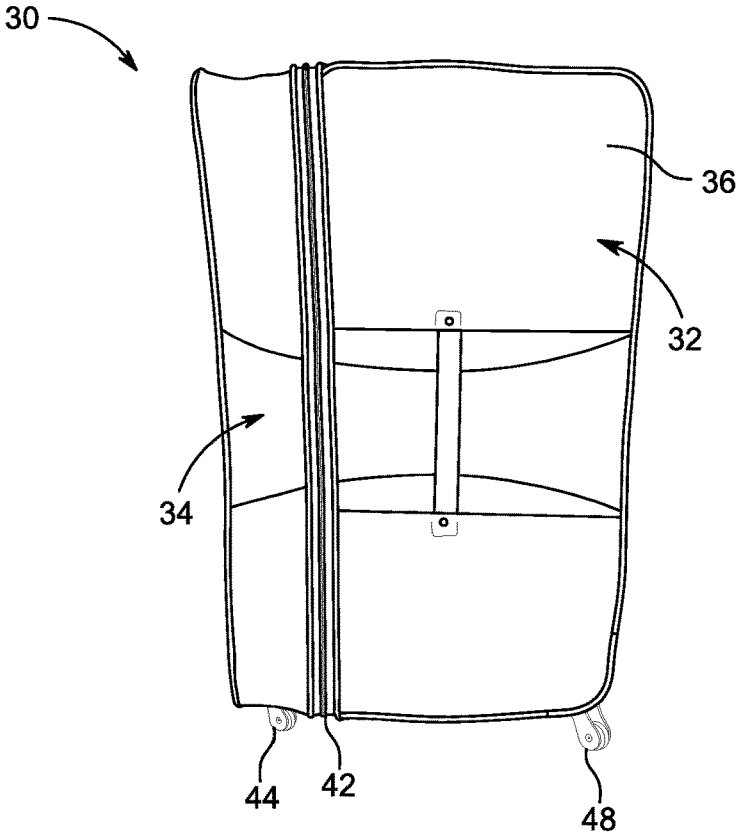
FIG. 2 is a right side elevational view depicting the suitcase of FIG. 1.
Figure 3:
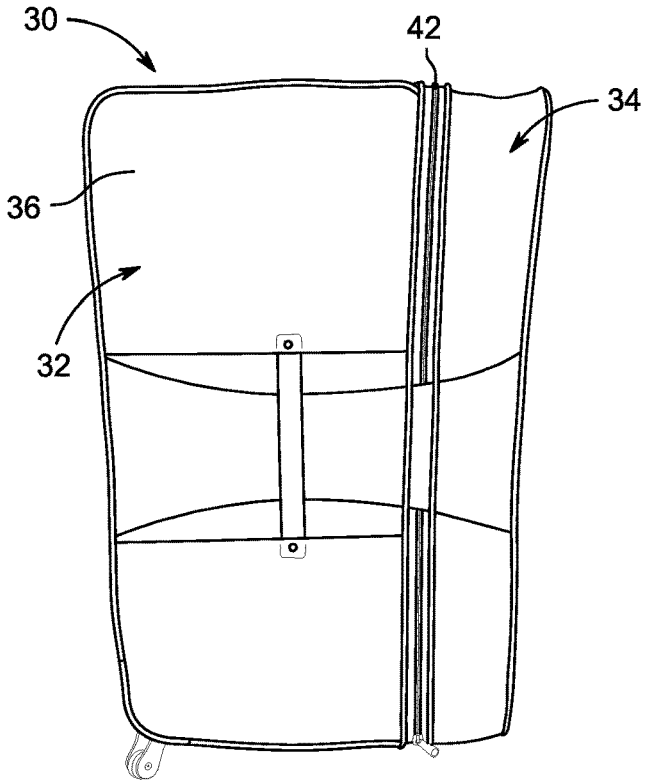
FIG. 3 is a left side elevational view depicting the suitcase of FIG. 1.
Figure 4:
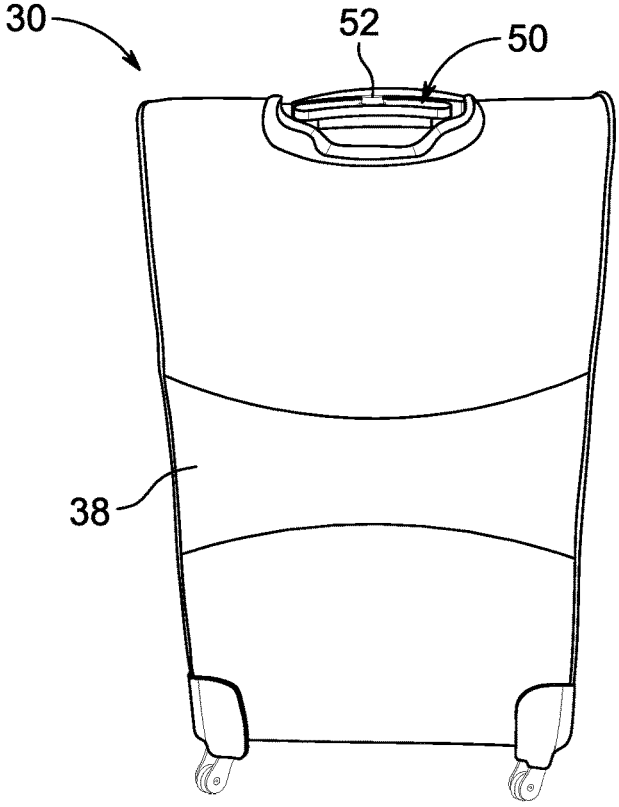
FIG. 4 is a rear elevational view depicting the suitcase of FIG. 1.
Figure 5:
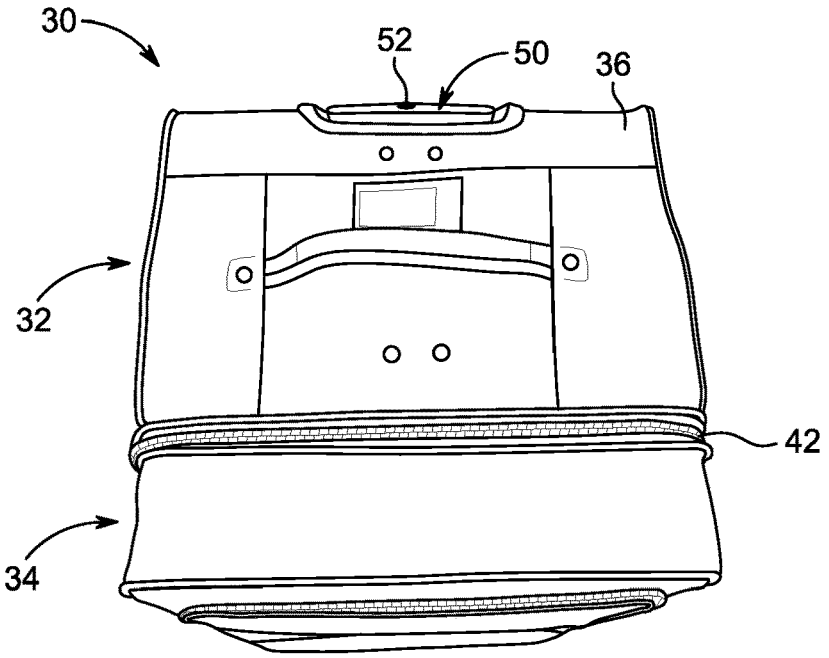
FIG. 5 is a top plan view depicting the suitcase of FIG. 1, with a telescoping handle shown in a retracted position.

Embodiments are hereinafter described in detail in connection with the views and examples of FIGS. 1-21, wherein like numbers indicate the same or corresponding elements throughout the views. FIGS. 1-21 illustrate a suitcase 30 that can be particularly suitable for transporting articles of clothing and other items often required for competing in a dancing competition. It is to be appreciated, however, that the suitcase 30 can be suitable for any of a variety of other possible traveling scenarios (e.g., for business travel or leisure travel). As illustrated in FIGS. 1-9, the suitcase 30 can include a main body 32 and a front door 34. The main body 32 can include a plurality of sidewalls 36 and a rear wall 38 that cooperate to define a storage compartment 40 (FIG. 9). The front door 34 is pivotally coupled with at least one of the sidewalls 36 and is pivotable between a closed position (FIGS. 1-8) and an opened position (FIG. 9). The front door 34 can be selectively opened to allow for loading and/or retrieval of items to/from the storage compartment 40. A zipper 42 can be routed along a perimeter of the front door 34 to facilitate selective securement of the front door 34 to the sidewalls 36 when in the closed position. The zipper 42 can be unzipped to gain access to the storage compartment 40. It is to be appreciated that the front door 34 can be selectively secured to adjacent sidewalls with any of a variety of closure members, such as buttons or straps, for example.

Figure 8:
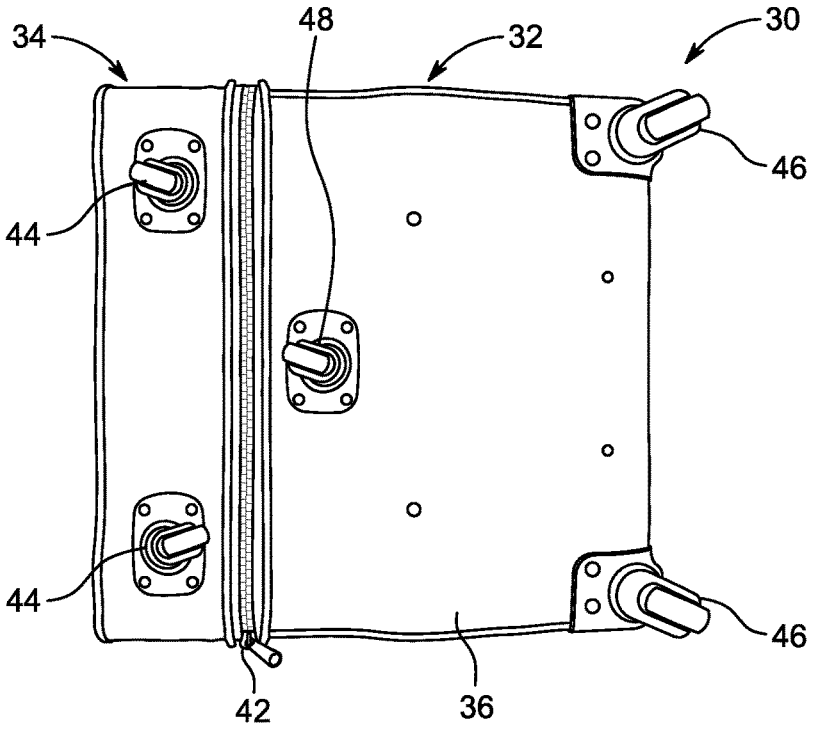
FIG. 8 is a bottom plan view depicting the suitcase of FIG. 1.
Figure 9:
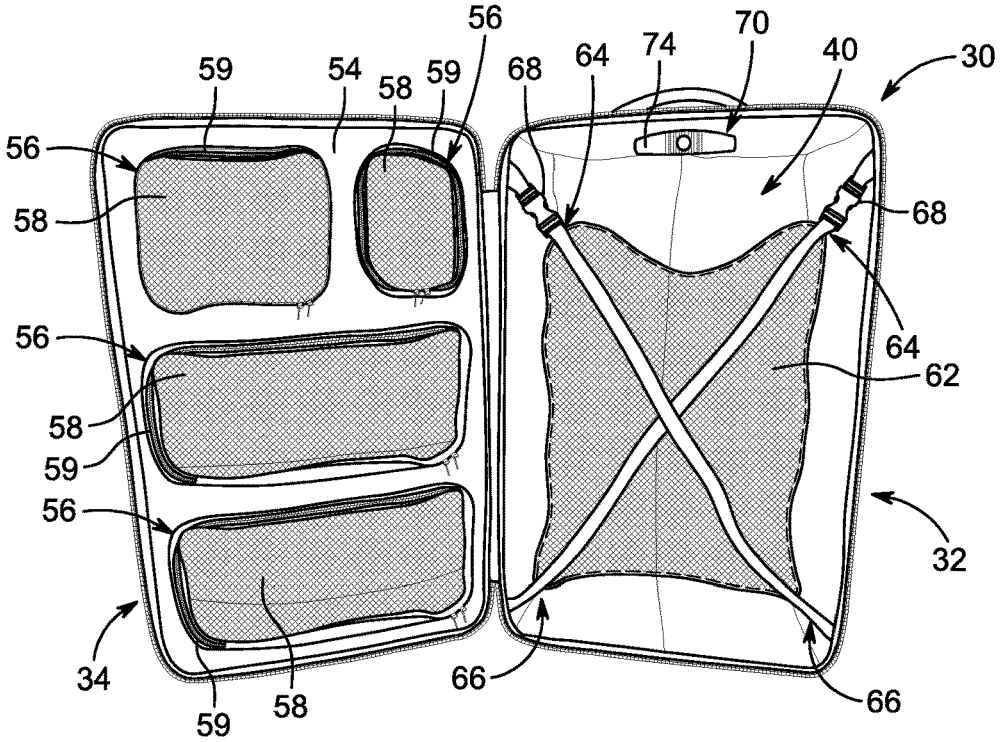
FIG. 9 is a front elevational view depicting the suitcase of FIG. 1, with a front door shown opened, a cover panel shown in a retained position, and a garment hanger assembly shown in a retracted position.

Referring now to FIG. 8, the suitcase 30 can comprise a pair of front wheels 44 coupled with the front door 34, a pair of rear wheels 46 coupled with the main body 32, and a middle wheel 48 coupled with main body 32 and disposed between the front wheels 44 and the rear wheels 46. Since the front wheels 44 are coupled with the front door 34, the front wheels 44 can travel together with the front door 34 when the front door 34 is opened and closed. In one embodiment, as illustrated in FIG. 8, each of the front wheels 44, rear wheels 46, and middle wheel 48 can comprise swivel wheels that are each configured to swivel with respect to the main body 32 and front door 34. In such an embodiment, the suitcase 30 can be transported in an upright position, as illustrated in FIGS. 1-4 without requiring tipping of the suitcase onto only two of the wheels (e.g., the rear wheels 46). The arrangement of the front wheels 44, the rear wheels 46, and the middle wheel 48 can be a sturdy base for the suitcase 30 during transportation and can enhance the stability of the suitcase 30 during loading and unloading. It is also to be appreciated that although the suitcase 30 is described and shown as having five wheels, any quantity of wheels (e.g., one, two, three, four, or more than five) can be provided on the suitcase 30.

Figure 6:
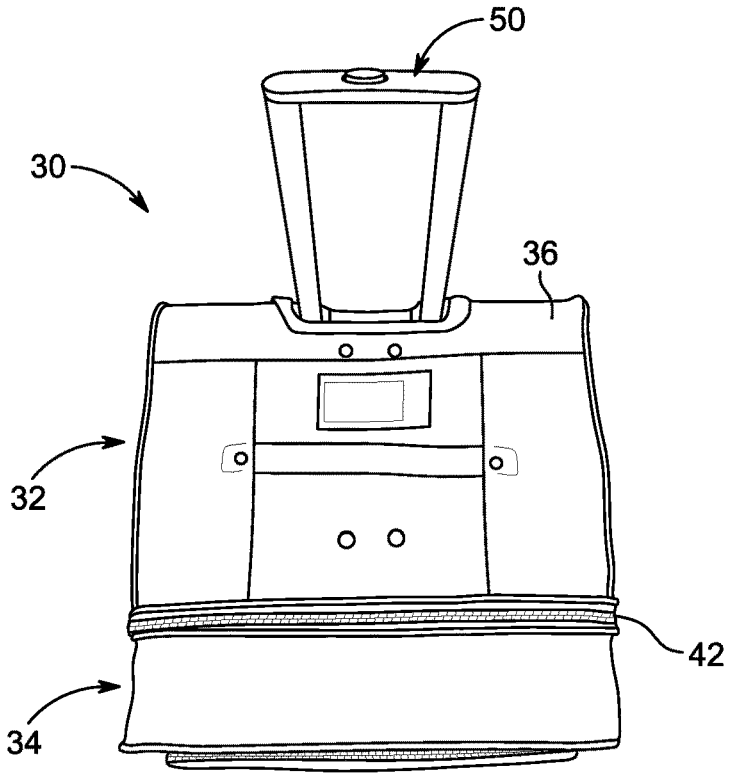
FIG. 6 is a top plan view depicting the suitcase of FIG. 5, but with the telescoping handle shown in an extended position.
Figure 7:
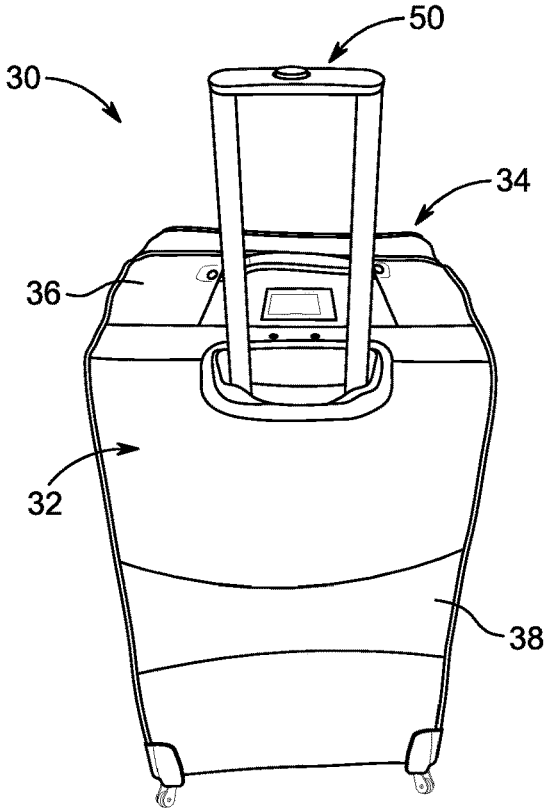
FIG. 7 is a rear isometric view depicting the suitcase of FIG. 6.

Referring now to FIGS. 4-7, the suitcase 30 can include a telescoping handle 50 coupled with the rear wall 38. The telescoping handle 50 can be slidable between a retracted position (FIGS. 4 and 5) and an extended position (FIGS. 6 and 7). A user can selectively extend the telescoping handle 50 by actuating a button 52 (or other release mechanism) and pulling the telescoping handle 50 upwardly. The user can then tip the suitcase 30 onto the rear wheels 46 and transport the suitcase 30 by pulling the telescoping handle 50. Once the suitcase 30 has reached its destination, the user can collapse the telescoping handle 50 for storage by actuating the release mechanism (not shown) and pushing the telescoping handle 50 downwardly.

Referring now to FIG. 9, the front door 34 is shown to be opened with the suitcase 30 upright to reveal the storage compartment 40. When the front door 34 is opened and closed with the suitcase 30 upright, the front door 34 can roll on the front wheels 44 which can allow for more effortless movement of the front door 34 than some conventional arrangements. In addition, once the front door 34 has been opened, the front wheels 44 can support the front door 34 and the rear and middle wheels 46, 48 can support the main body 32 to enhance the stability of the suitcase 30 during loading and unloading and prevent the front door 34 from inadvertently closing and/or collapsing.

Figure 10:
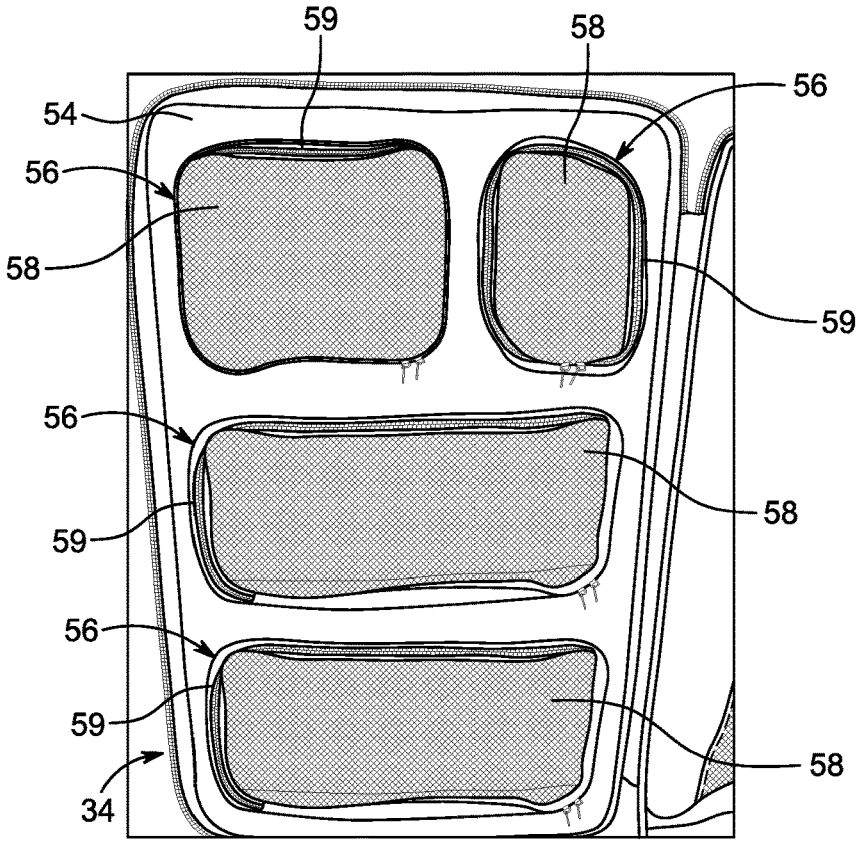
FIG. 10 is an enlarged elevational view depicting the front door of the suitcase of FIG. 9.

Referring now to FIGS. 9 and 10, an internal panel 54 can extend along the front door 34 and can define a plurality of pockets 56. The internal panel 54 can include a plurality of closure panels 58 that each selectively overlie the one of the pockets 56. In one embodiment, each closure panel 58 can be selectively secured over one of the pockets 56 by a zipper 59, or with any of a variety of suitable alternative closure arrangements. In one embodiment, each of the pockets 56 can be configured to accommodate one or more designated items. For example, one of the pockets 56 can be configured to accommodate a curling iron, another of the pockets can be configured to accommodate makeup, another of the pockets can be configured to accommodate footwear, and another of the pockets can be configured to accommodate jewelry. It is to be appreciated however that the pockets 56 can be configured to accommodate any of a variety of individual or combinations of designated items. It is also to be appreciated that although four pockets 56 are shown in FIGS. 9 and 10, that any quantity of pockets (i.e., one, two, three or more than four) and any arrangement of pockets 56 is contemplated.

Figure 11:
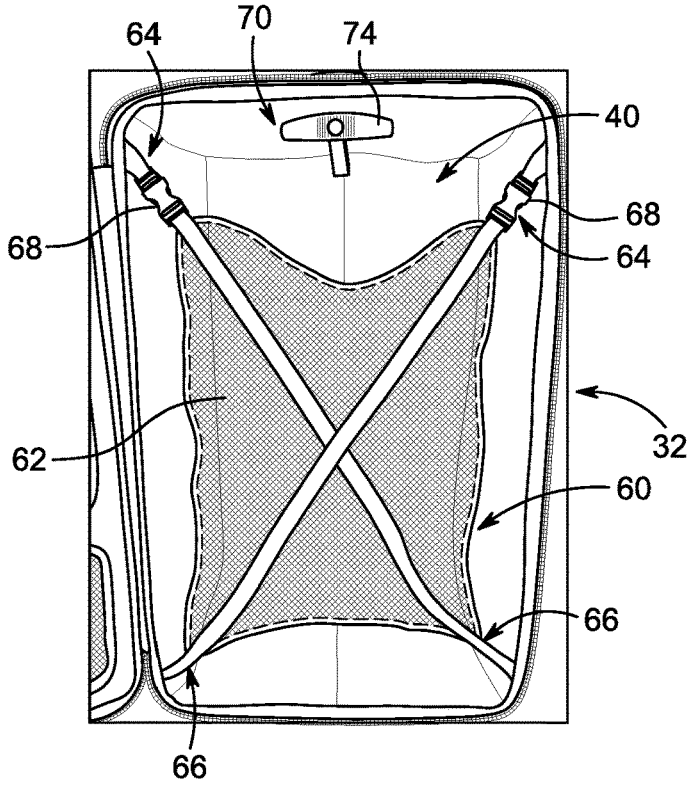
FIG. 11 is an enlarged elevational view depicting a main body of the suitcase of FIG. 9.
Figure 12:
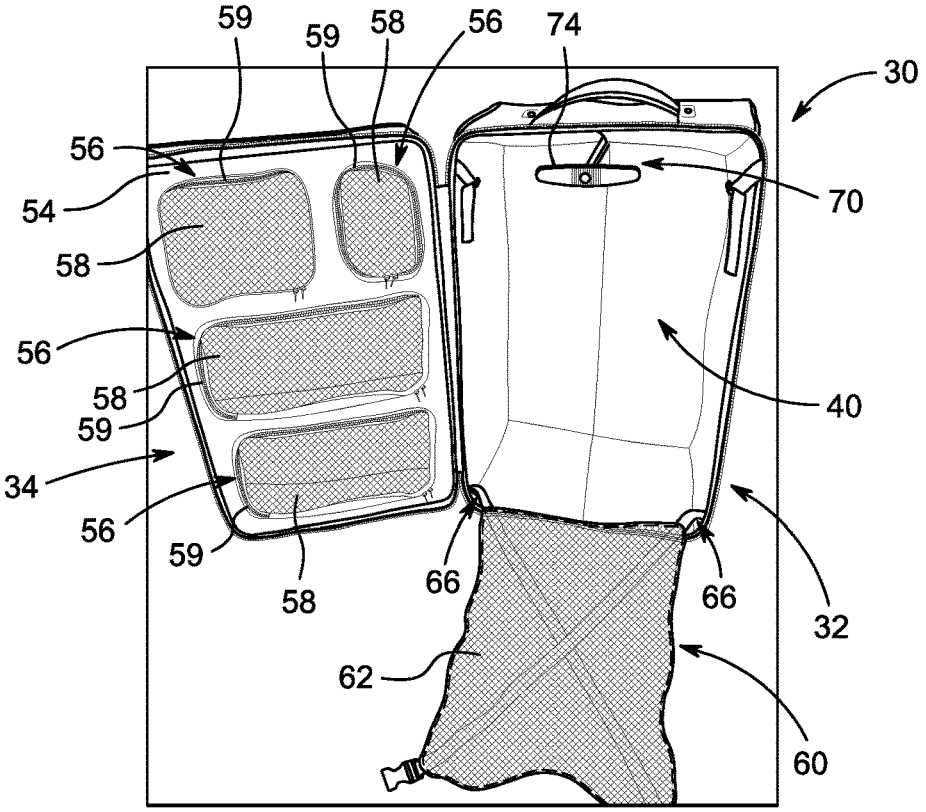
FIG. 12 is a front elevational view depicting the suitcase of FIG. 9, but with the cover panel shown in a deployed position and the garment hanger assembly shown in an extended position.
Figure 13:
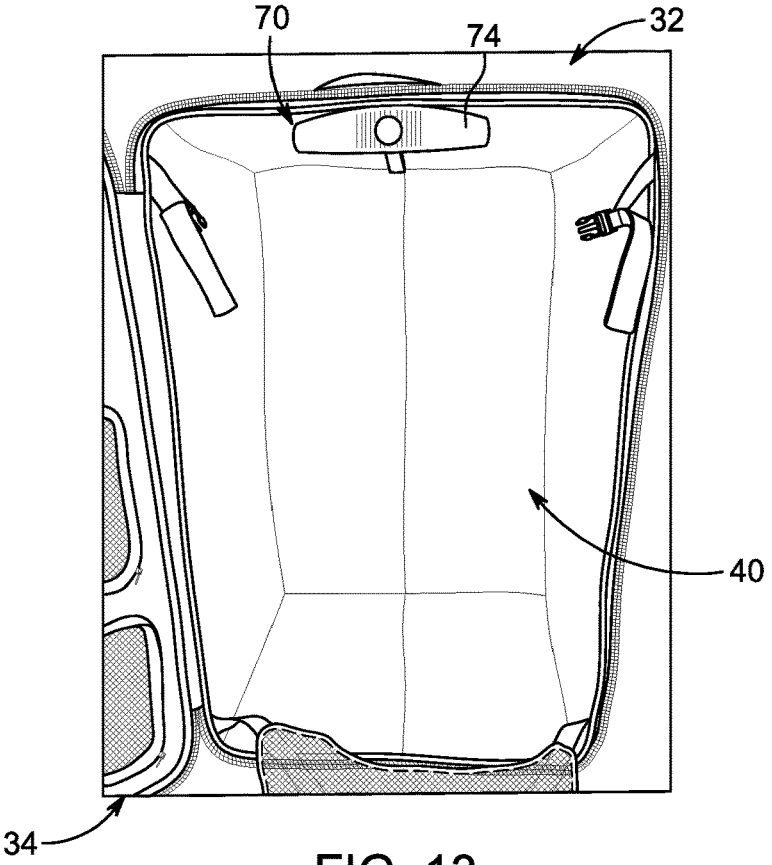
FIG. 13 is an enlarged elevational view depicting the suitcase of FIG. 12.
Figure 14:
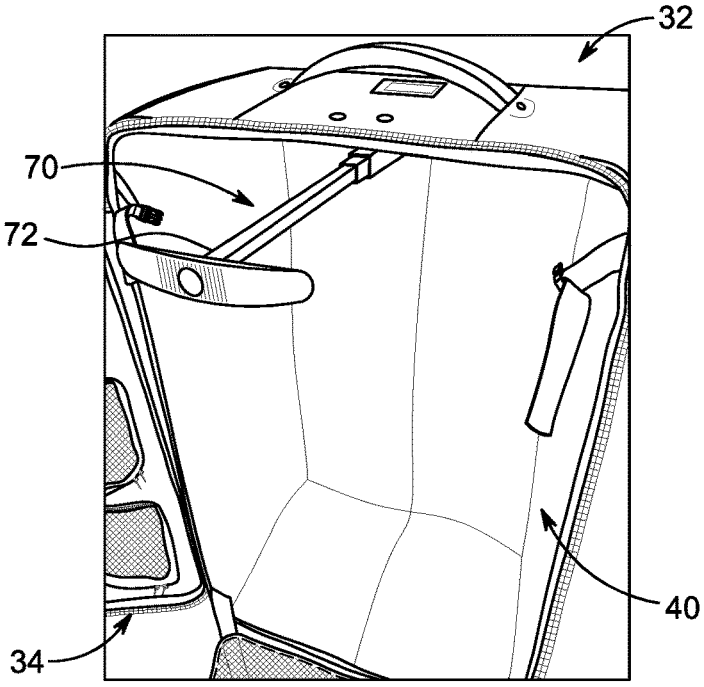
FIG. 14 is an enlarged upper isometric view depicting the suitcase of FIG. 12.
Figure 15:
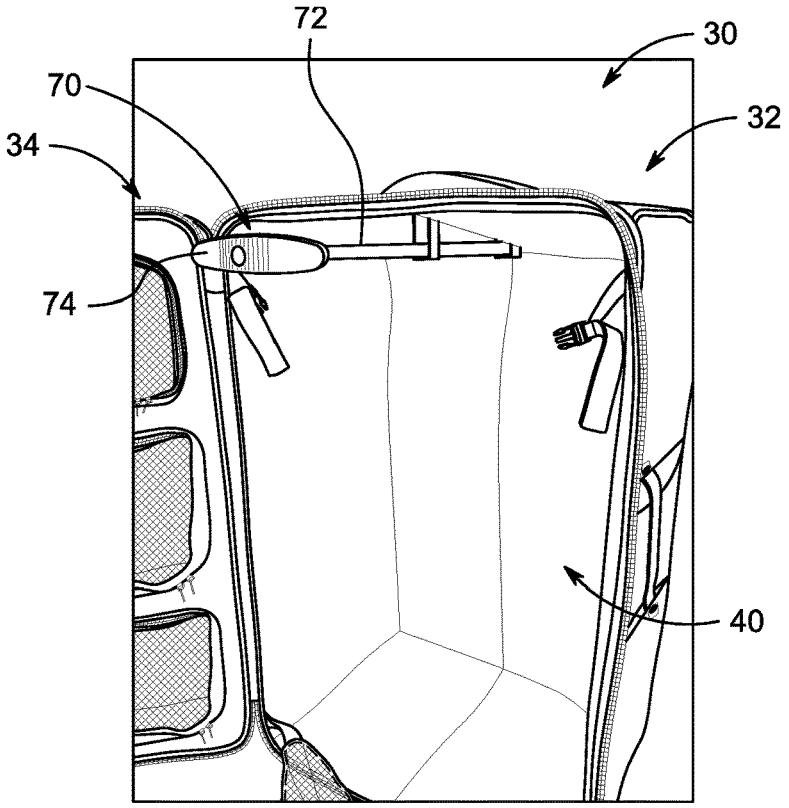
FIG. 15 is an enlarged side isometric view depicting the suitcase of FIG. 12.
Figure 16:
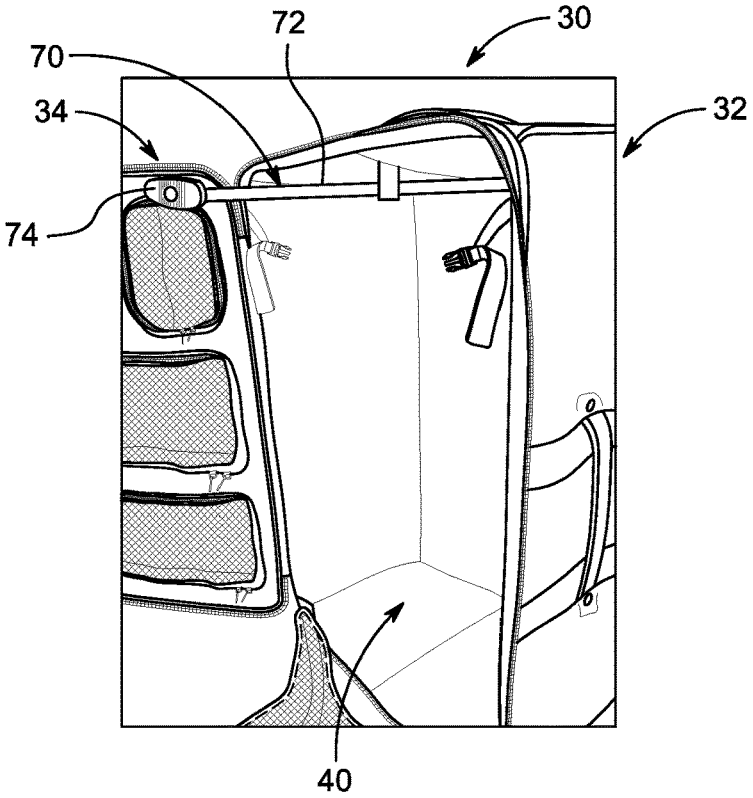
FIG. 16 is an enlarged side isometric view depicting the suitcase of FIG. 12.
Figure 17:
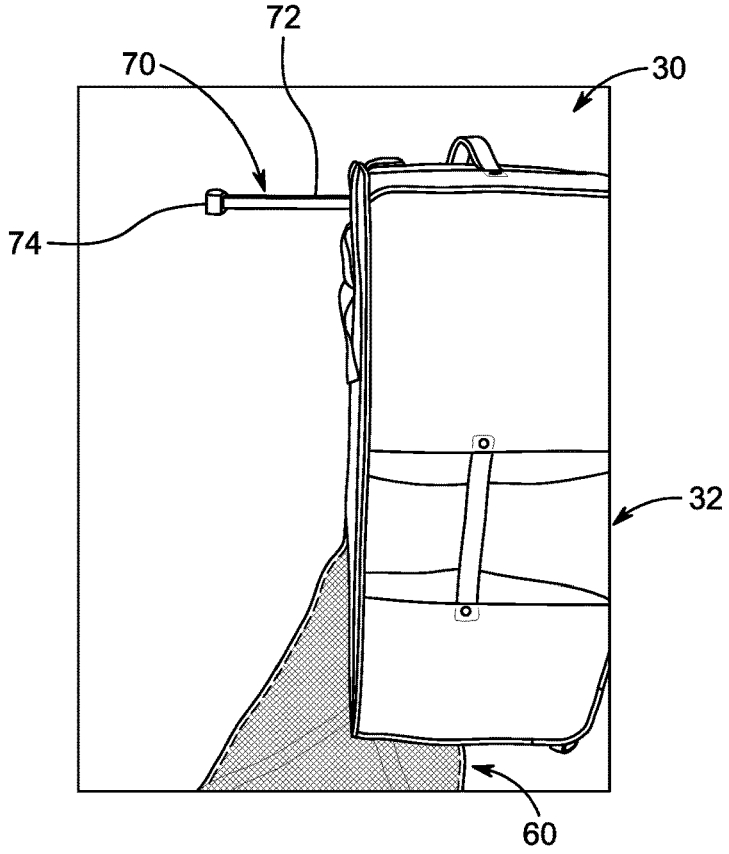
FIG. 17 is a side elevational view depicting the suitcase of FIG. 12.

Referring now to FIGS. 11 and 12, the suitcase 30 can include a cover panel 60 that is releasably coupled to the main body 32 and configured to selectively overlie the storage compartment 40. The cover panel 60 can include a panel portion 62, a pair of upper straps 64, and a pair of lower straps 66. Each of the upper straps 64 and the lower straps 66 can extend from the panel portion 62. In one embodiment, the panel portion 62 can be formed of a non-rigid mesh fabric. In another embodiment, the panel portion 62 can be formed of a semi-rigid material (i.e., fiberboard) that is covered with fabric. It is to be appreciated that the panel portion 62 can be formed of any of a variety of suitable alternative, non-rigid, semi-rigid, or rigid materials/fabrics or some combination thereof.

The cover panel 60 can be movable from between a retained position (FIG. 11) and a deployed position (FIG. 12). When in the retained position (FIG. 11), the cover panel 60 can overlie the storage compartment 40 to facilitate retention of any contents disposed therein (e.g., folded clothing). When in the deployed position (FIG. 12), the cover panel 60 can extend from the main body 32 adjacent to the storage compartment 40. The cover panel 60 can overlie a floor surface disposed adjacent to the main body 32 (when the suitcase 30 is upright) to protect any contents removed from the suitcase 30 from contacting the floor surface. In one embodiment, the lower straps 66 can be fixedly attached to the main body 32 and the upper straps 64 can be releasably attached to the main body 32 with buckles 68. In such an embodiment, the upper straps 64 can be selectively attached and released to/from the main body 32 via the buckles 68 to facilitate selective positioning of the cover panel 60 in either the retained position or the released position. In another embodiment, each of the upper and lower straps 64, 66 can be releasably attached to the main body 32 (e.g., with buckles 68) to allow for selective positioning of the cover panel (e.g., 60) in either the retained position or the released position as well as to allow for removal of the cover panel (e.g., 60) from the main body 32 entirely.

Referring now to FIGS. 11-17, the suitcase 30 can include a garment hanger assembly 70 that is slidably coupled with the main body 32 and is slidable between a retracted position (FIG. 11) and an extended position (FIGS. 12-17). The garment hanger assembly 70 can include a garment rod 72 and a handle 74. The garment rod 72 can be attached at one end to the rear wall 38 of the main body 32 and at the other end to the handle 74. In one embodiment, the garment rod 72 can comprise a telescoping rod that facilitates sliding of the garment hanger assembly 70 between the retracted position and the extended position. It is to be appreciated however that the garment rod 72 can be any of a variety of suitable alternative arrangements that facilitate movement of a garment hanger assembly (e.g., 70) between a retracted position and an extended position.

The handle 74 can be configured to allow for grasping by a user to facilitate manual sliding of the garment hanger assembly 70 between the retracted position and the extended position. In one embodiment, the handle 74 can include a lock button (not shown) that facilitates selective locking of the garment hanger assembly 70 in either of the retracted position or the extended position. When the garment hanger assembly 70 is in either of the retracted position and the extended position, a user can depress the lock button to unlock the garment hanger assembly 70 for sliding into a different position. In another embodiment, the garment hanger assembly 70 can include an internal latching mechanism (not shown) that facilitates selective retention of the garment hanger assembly 70 in either of the retracted position and the extended position. When the garment hanger assembly 70 is in either of the retracted position and the extended position, a user can pull or push the handle 74 with enough force to overcome the internal latching assembly in order to facilitate sliding of the garment hanger assembly 70 into a different position.

As illustrated in FIG. 11, when the garment hanger assembly 70 is in the retracted position, the garment hanger assembly 70 can be disposed substantially entirely within the storage compartment 40 to allow for closing of the front door 34. As illustrated in FIGS. 12-17, when the garment hanger assembly 70 is in the extended position, the garment hanger assembly 70 can extend at least partially from the storage compartment 40 such that the garment rod 72 is accessible from outside of the storage compartment 40.

Figure 18:
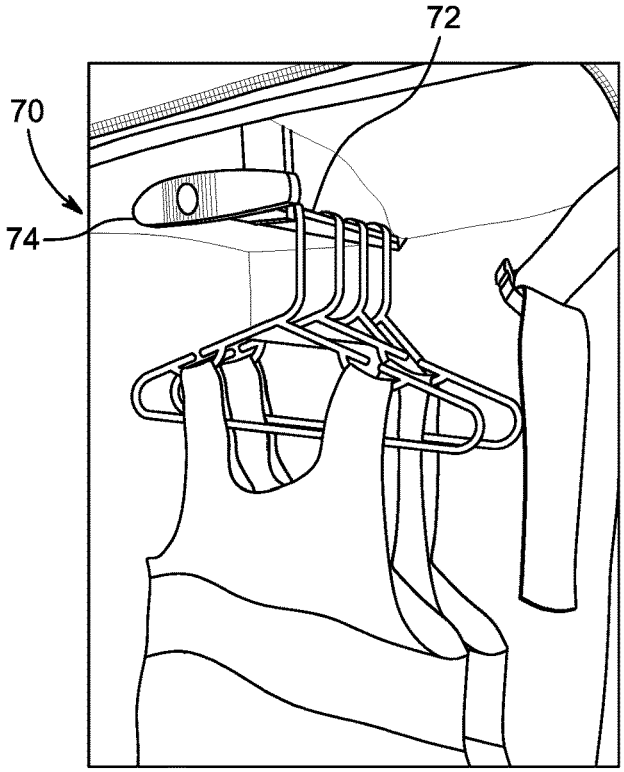
FIG. 18 is an enlarged side isometric view of the suitcase of FIG. 11, but with garments shown hanging on the garment hanger assembly in the retracted position and the cover panel removed for clarity of illustration.
Figure 19:
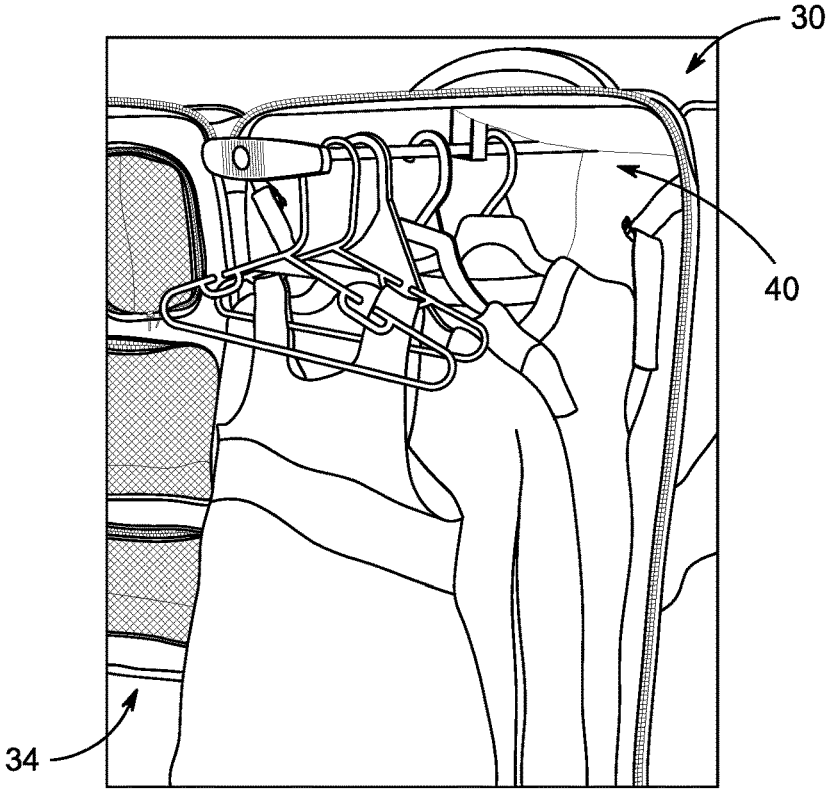
FIG. 19 is an enlarged side isometric view of the suitcase of FIG. 18, but with the garment hanger assembly shown in the extended position.
Figure 20:
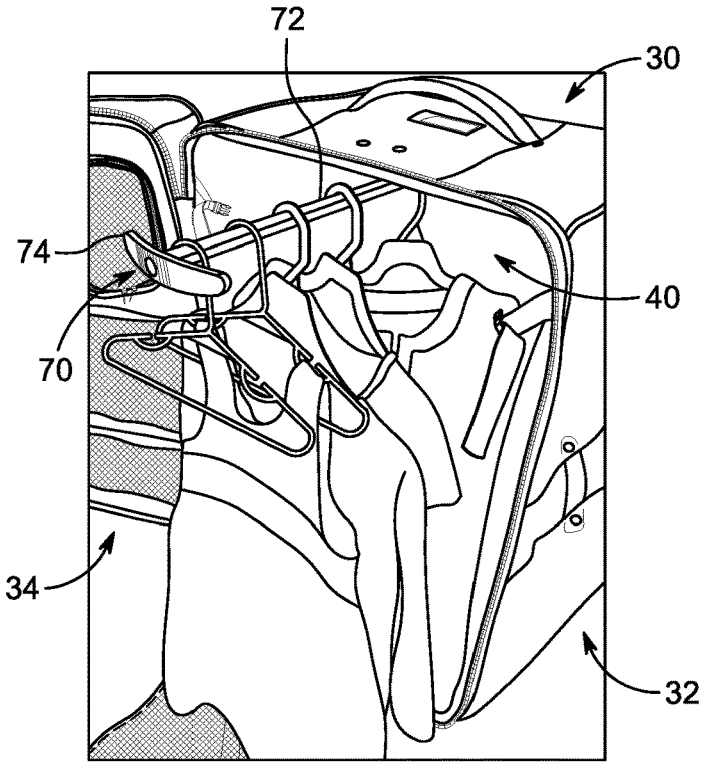
FIG. 20 is an enlarged upper isometric view of the suitcase of FIG. 19.
Figure 21:
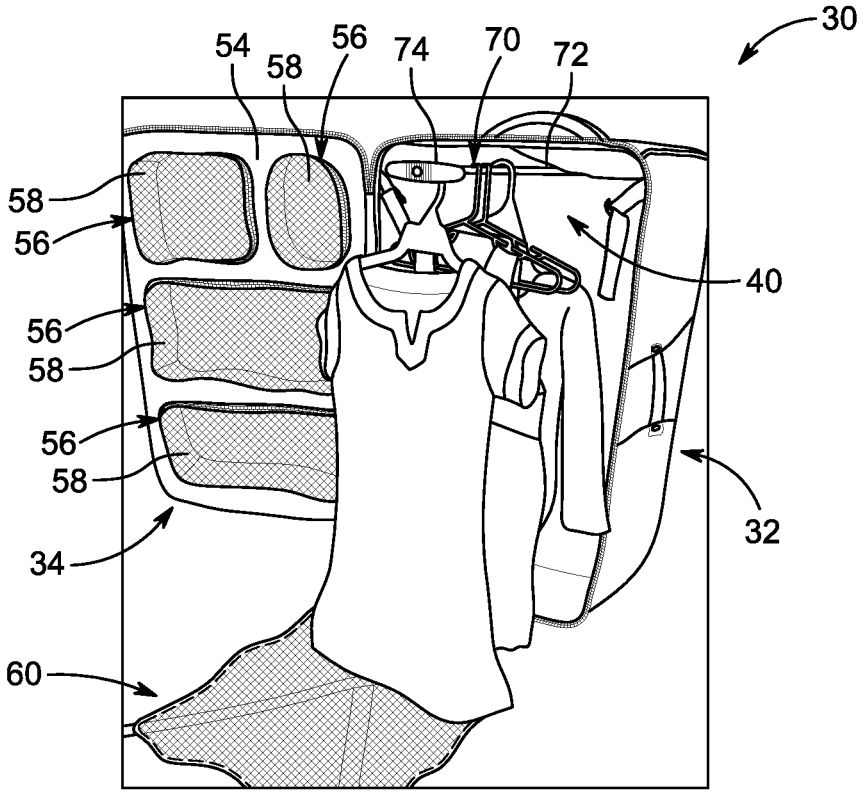
FIG. 21 is an upper isometric view of the suitcase of FIG. 19, but with other garments shown hanging on the garment hanger assembly.

Referring now to FIGS. 18-21, the garment hanger assembly 70 can be configured to support hanging garments. When the hanging garments are hung on the garment hanger assembly 70, the handle 74 can prevent the garments from sliding off of the end of the garment rod 72. Turning now to FIG. 18, when the garment hanger assembly 70 is in the retracted position, the garments hung on the garment hanger assembly 70 can be disposed within the storage compartment 40. Turning now to FIGS. 19-21, when the garment hanger assembly 70 is in the extended position, the garments hung on the garment rod 72 can be disposed outside of the storage compartment 40 to allow for ease of access thereto.

As illustrated in FIG. 21, when the garment hanger assembly 70 is in the extended position, the cover panel 60 can be provided in the deployed position in order to underlie the garments that are disposed outside of the storage compartment 40 to prevent them from contacting the floor.

As indicated above, the suitcase 30 can be particularly suitable for transporting articles of clothing and other items often required for competing in a dancing competition. For example, a user can pack the suitcase 30 by first standing the suitcase 30 upright, opening the front door 34, sliding the garment hanger assembly 70 to the extended position and moving the cover panel 60 to the deployed position, as illustrated in FIG. 12. The user can then hang the outfits for the dance competition on the garment hanger assembly 70, as illustrated in FIGS. 20 and 21. Once all of the garments have been hung on the garment hanger assembly 70, the user can slide the garment hanger assembly 70 to the retracted position, as illustrated in FIG. 18. Each of the pockets 56 can then be filled with other items that are needed for the dance competition such as a curling iron, footwear, or jewelry, for example, and each of the closure panels 58 can then be secured over the pockets 56 (e.g., with the zipper 59) to constrain the items within the pockets 56. The suitcase 30 can then be laid down (e.g., on the rear wall 38) and any additional items can be provided in the storage compartment 40. The cover panel 60 can then be returned to its retained position to facilitate securement of the contents within the storage compartment 40. The front door 34 can then be closed and secured to the main body with the zipper 42. The suitcase 30 can then be returned to the upright position and the telescoping handle 50 can be slid into the extended position to allow the suitcase 30 to be transported. Once the suitcase 30 has reached its destination, the user can lay the suitcase 30 on its rear wall 38 and can open the front door 34 by unzipping the zipper 42, and the cover panel 60 can be at least partially released from the retained position to gain access to the storage compartment 40. Any items not hung on the garment hanger assembly 70 can be removed, and the suitcase 30 can then be provided into an upright position. The cover panel 60 can then be pulled in front of the main body 32, and the garment hanger assembly 70 can be slid to the extended position to gain access to the hanging garments.

It is to be appreciated that by hanging the garments on the garment hanger assembly 70, the garments can remain upright (i.e., in a hanging position) during transportation which can prevent wrinkling of the garments more effectively than conventional suitcases and garment bags. The garments can therefore require little to no ironing or other preparation when removed from the suitcase 30. It is also to be appreciated that the suitcase 30 can be utilized as a garment rack when transported to a dance competition thereby alleviating the need for a separate rack or rod system on which to hang the garments as with conventional "bag to rack" suitcase arrangements.

It is to be appreciated that, although the suitcase 30 has been described in terms of facilitating transportation and effective presentation of dance related items, the suitcase 30 can be used for any of a variety of suitable alternative travel scenarios.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended that the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A suitcase comprising:

a main body comprising a top wall, a bottom wall, a left wall, a right wall, and a rear wall that cooperate with one another to define a storage compartment having a forward opening;

a front door pivotally coupled with the main body and pivotable between a closed position and an opened position;

at least two rearward wheels coupled with the bottom wall at a location adjacent to the rear wall, wherein the at least two rearward wheels are generally arranged on a first axis;

at least one forward wheel coupled with the bottom wall at a location adjacent to the forward opening, wherein the at least one forward wheel is arranged on a second axis;

at least two door wheels coupled with the front door such that the door wheels travel together with the front door when the front door is pivoted between the closed position and the opened position, wherein:

the at least two door wheels are generally arranged on a third axis;

each of the first axis, the second axis and the third axis are coplanar;

the second axis is generally parallel with and spaced from the first axis;

the third axis is generally parallel with and spaced from the second axis when the front door is in the closed position; and a garment hanger assembly slidable between a retracted position and an extended position, the garment hanger assembly comprising a garment rod and a handle, the garment rod being attached at one end to the rear wall of the main body and at another end to the handle;

an internal panel extending along the front door and defining a plurality of pockets, the internal panel comprising a plurality of closure panels, each closure panel of the plurality of closure panels selectively overlying a respective pocket of the plurality of pockets; and a cover panel comprising a panel portion, a pair of upper straps, and a pair of lower straps, wherein the upper straps are releasably attached to the main body and facilitate selective movement of the cover panel between a retained position and a deployed position.

* * * * *